US011116378B2

(12) United States Patent
Goff

(10) Patent No.: US 11,116,378 B2
(45) Date of Patent: Sep. 14, 2021

(54) FLOOR MAINTENANCE MACHINE DECK ASSEMBLY

(71) Applicant: RPS Corporation, Racine, WI (US)

(72) Inventor: Sean K. Goff, Breckenridge, CO (US)

(73) Assignee: RPS Corporation, Racine, WI (US)

( * ) Notice: Subject to any disclaimer, the term of this patent is extended or adjusted under 35 U.S.C. 154(b) by 277 days.

(21) Appl. No.: 16/287,029

(22) Filed: Feb. 27, 2019

(65) Prior Publication Data

US 2019/0261826 A1 Aug. 29, 2019

Related U.S. Application Data

(60) Provisional application No. 62/636,538, filed on Feb. 28, 2018.

(51) Int. Cl.

| | |
|---|---|
| ***A47L 11/40*** | (2006.01) |
| ***A47L 9/04*** | (2006.01) |
| ***A47L 11/24*** | (2006.01) |

(52) U.S. Cl.

CPC ..... *A47L 11/4058* (2013.01); *A47L 9/0472* (2013.01); *A47L 9/0483* (2013.01); *A47L 9/0494* (2013.01); *A47L 11/24* (2013.01); *A47L 11/4038* (2013.01)

(58) Field of Classification Search

CPC ..... A47L 11/4058; A47L 11/4055; A47L 11/4052; A47L 11/24; A47L 11/28; A47L 11/4038; A47L 9/0472; A47L 9/0494

See application file for complete search history.

(56) References Cited

U.S. PATENT DOCUMENTS

| | | | | |
|---|---|---|---|---|
| 1,979,797 | A * | 11/1934 | Finnell | A47L 11/305 15/50.1 |
| 9,249,547 | B2 * | 2/2016 | Du Maire | A47L 11/4052 |
| 9,498,099 | B2 * | 11/2016 | Shinler | A47L 11/4055 |
| 2002/0170130 | A1 * | 11/2002 | Shinler | A47L 11/283 15/49.1 |

* cited by examiner

*Primary Examiner* — Laura C Guidotti

(74) *Attorney, Agent, or Firm* — Quarles & Brady LLP

(57) ABSTRACT

A floor maintenance machine has an adjustable deck assembly. The floor maintenance machine includes a deck supporting a floor cleaning implement. A lifting arm extends away from a frame of the floor maintenance machine and is rotatably coupled to the deck. The lifting arm is rotatably actuatable to adjust a position of the deck relative to the frame. A support member is rotatably coupled to the frame and movably coupled to the deck. A stop member is supported by the deck and extends toward the lifting arm for selective engagement therewith. When the lifting arm is rotated relative to the frame to lift the deck, the stop member is driven into the lifting arm to limit relative rotation between the lifting arm and the deck beyond a set angle.

19 Claims, 7 Drawing Sheets

FLOOR MAINTENANCE MACHINE DECK ASSEMBLY

CROSS-REFERENCES TO RELATED APPLICATIONS

This application claims the benefit of U.S. Provisional Patent Application No. 62/636,538 filed on Feb. 28, 2018, the contents of which are incorporated by reference for all purposes as if set forth in their entirety herein.

STATEMENT REGARDING FEDERALLY SPONSORED RESEARCH

Not Applicable.

BACKGROUND

The present disclosure relates, in general, to floor maintenance machines. More particularly, this disclosure relates to systems and methods of adjusting a position of a scrub deck on a floor maintenance machine.

Floor maintenance machines or scrubbers provide a way to clean dirty floor surfaces. Typically, an operator directs a floor maintenance machine over the surface to be cleaned by steering or guiding the floor maintenance machine. With the help of a supplied cleaning fluid, an oscillating pad or rotating brushes contained within a scrub deck of the floor maintenance machine can directly contact the floor surface to loosen debris on a surface of the floor. A variety of pads and suction devices on the floor maintenance machine can be used to then remove the loosened debris from the floor surface to clean the floor.

In some situations, floor maintenance machines are used to clean floor surfaces at different locations. Accordingly, floor maintenance machines are often transported to separate buildings or sites by truck, trailer bed, or other types of transportation devices. The floor maintenance machines are generally loaded and unloaded from the transportation device using a ramp, allowing the floor maintenance machine to transition from the ground to the transportation device, and vice versa.

Ramps are proven effective at moving floor maintenance machines on and off a transportation device, although the scrub deck (and cleaning implements) of a floor maintenance machine may be damaged by the ramp or the ground during loading and unloading. When the floor maintenance machine transitions between the ground and the ramp, the positioning of the scrub deck (e.g., forward of the front wheels and parallel to the ground) and the relatively low clearance with the ground may cause the scrub deck to contact or impact the ramp or ground before the floor maintenance machine adjusts to the gradient of the ramp or ground. These impacts and contacts can damage the scrub deck and can eventually lead to component failure.

BRIEF SUMMARY

The present disclosure provides systems and methods for adjusting a position of a scrub deck on a floor maintenance machine. Using embodiments of the disclosure, scrub decks can be tilted upward to reduce any damage caused by sudden elevational changes in the floor maintenance machine travel path. For example, the scrub deck can be tilted upward in an improved way to limit contact with a ramp or ground when the floor maintenance machine transitions between the ground and the ramp. Using the disclosed systems and methods, impacts and other undesired contact to the scrub deck is greatly limited, which can lead to longer component and machine life.

In one aspect, the present disclosure provides a floor maintenance machine having an adjustable deck assembly. The floor maintenance machine comprises a deck supporting a floor cleaning implement, a lifting arm, a support member, and a stop member. The lifting arm extends away from a frame of the floor maintenance machine and is rotatably coupled to the deck. The lifting arm is rotatably actuatable to adjust a position of the deck relative to the frame. The support member is rotatably coupled to the frame and movably coupled to the deck. The stop member is supported by the deck and extends toward the lifting arm for selective engagement with the lifting arm. When the lifting arm is rotated relative to the frame to lift the deck, the stop member is driven into the lifting arm to limit relative rotation between the lifting arm and the deck beyond a set angle.

These and still other advantages of the disclosure will be apparent from the detailed description and drawings. What follows is merely a description of some preferred embodiments of the present disclosure. To assess the full scope of the disclosure, the claims should be looked to as these preferred embodiments are not intended to be the only embodiments within the scope of the claims.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

Figure 1:
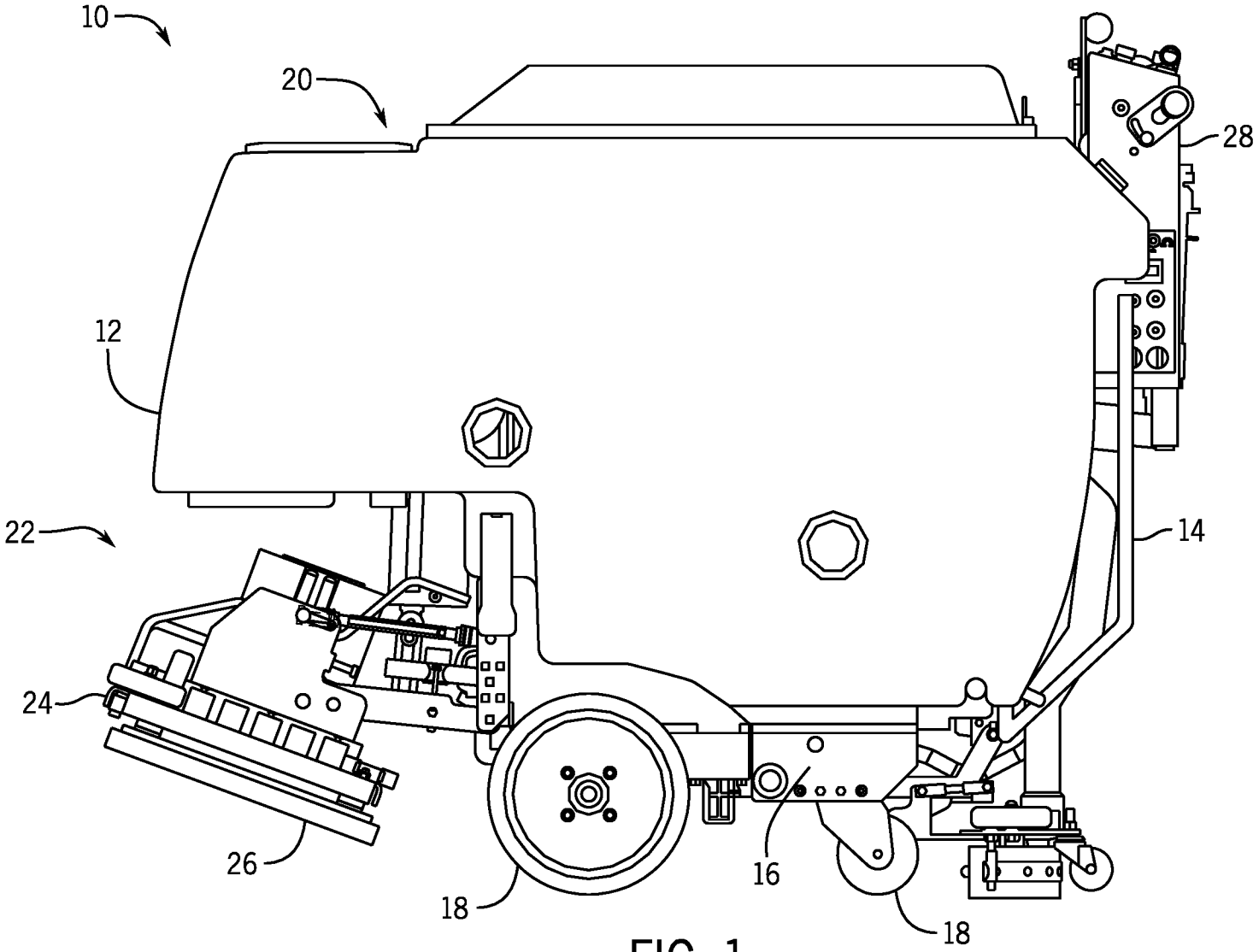
FIG. 1 is a side view of a floor maintenance machine.

Corresponding reference characters indicate corresponding parts throughout the several views. Although the drawings represent embodiments of the present disclosure, the drawings are not necessarily to scale and certain features may be exaggerated in order to better illustrate and explain the embodiments of the present disclosure.

DETAILED DESCRIPTION

For the purposes of promoting an understanding of the principles of the present disclosure, reference will now be made to a number of illustrative embodiments shown in the attached drawings and specific language will be used to describe the same.

FIG. 1 illustrates a floor maintenance machine 10 according to an embodiment of the disclosure. The floor maintenance machine has a front end 12 and a rear end 14 along which a frame 16 of the floor maintenance machine 10 extends. A set of wheels 18 are mounted to the frame 16 and are positioned to engage and drive the floor maintenance machine 10 upon a floor surface. A housing 20 extends over a portion of the frame 16 to enclose various fluid handling and power systems used by the floor maintenance machine 10. An adjustable deck assembly 22 including a scrub deck 24 is positioned near the front end 12 of the floor maintenance machine 10. The scrub deck 24 includes a floor cleaning implement 26 that is adapted for engagement with the floor surface. The floor cleaning implement can be a scrubber, a rotating brush, an oscillating pad, or other types of implements capable of mechanically altering debris present upon the floor surface. A control panel 28 can be positioned near the rear end 14 of the floor maintenance machine 10 to provide user access and control of the various fluid handling and power systems on the floor maintenance machine 10.

Figure 2:
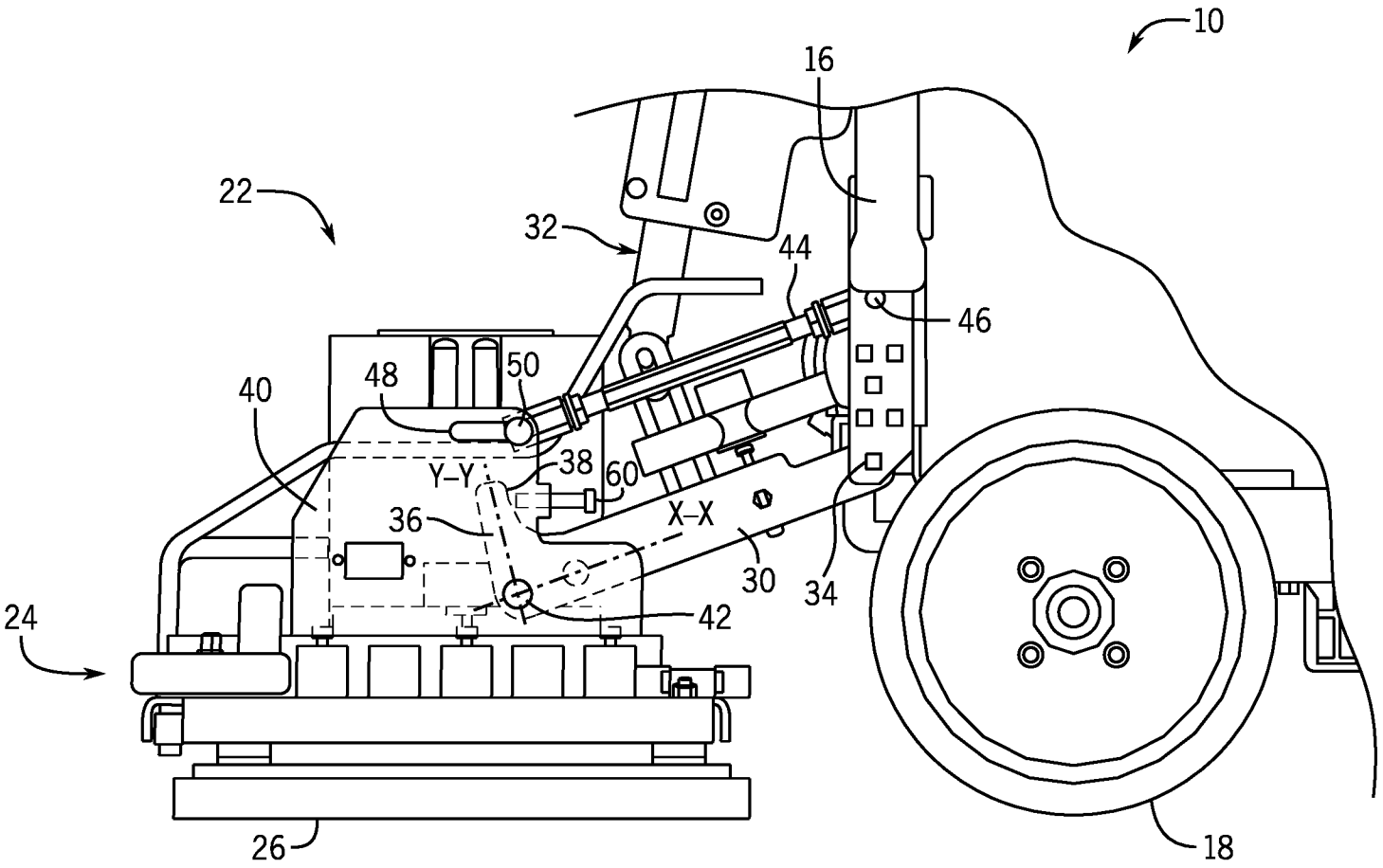
FIG. 2 is a detailed side view of a deck assembly on the floor maintenance machine of FIG. 1 in a lowered position.
Figure 4:
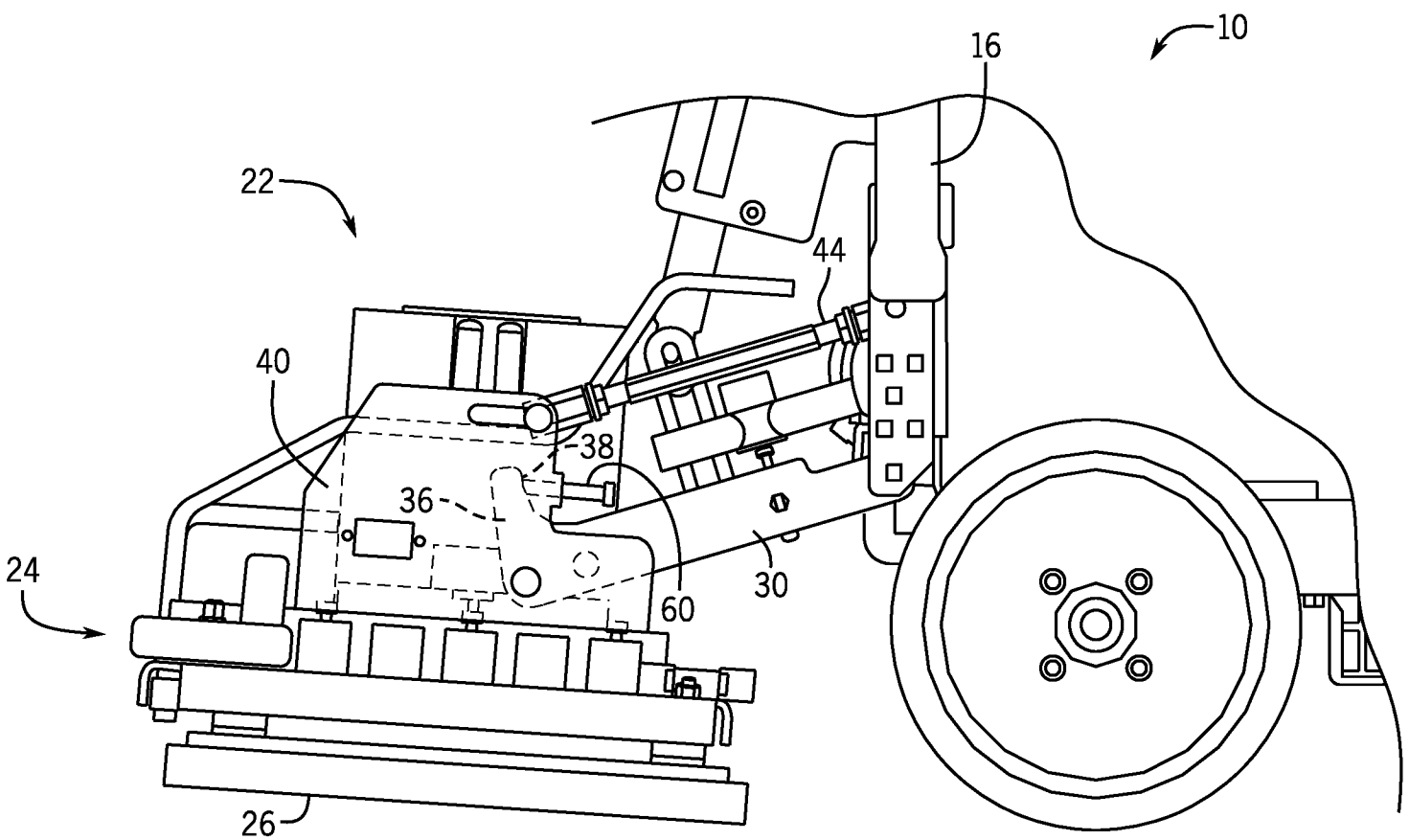
FIG. 4 is a detailed side view of a deck assembly on the floor maintenance machine of FIG. 1 in a slightly raised position.
Figure 5:
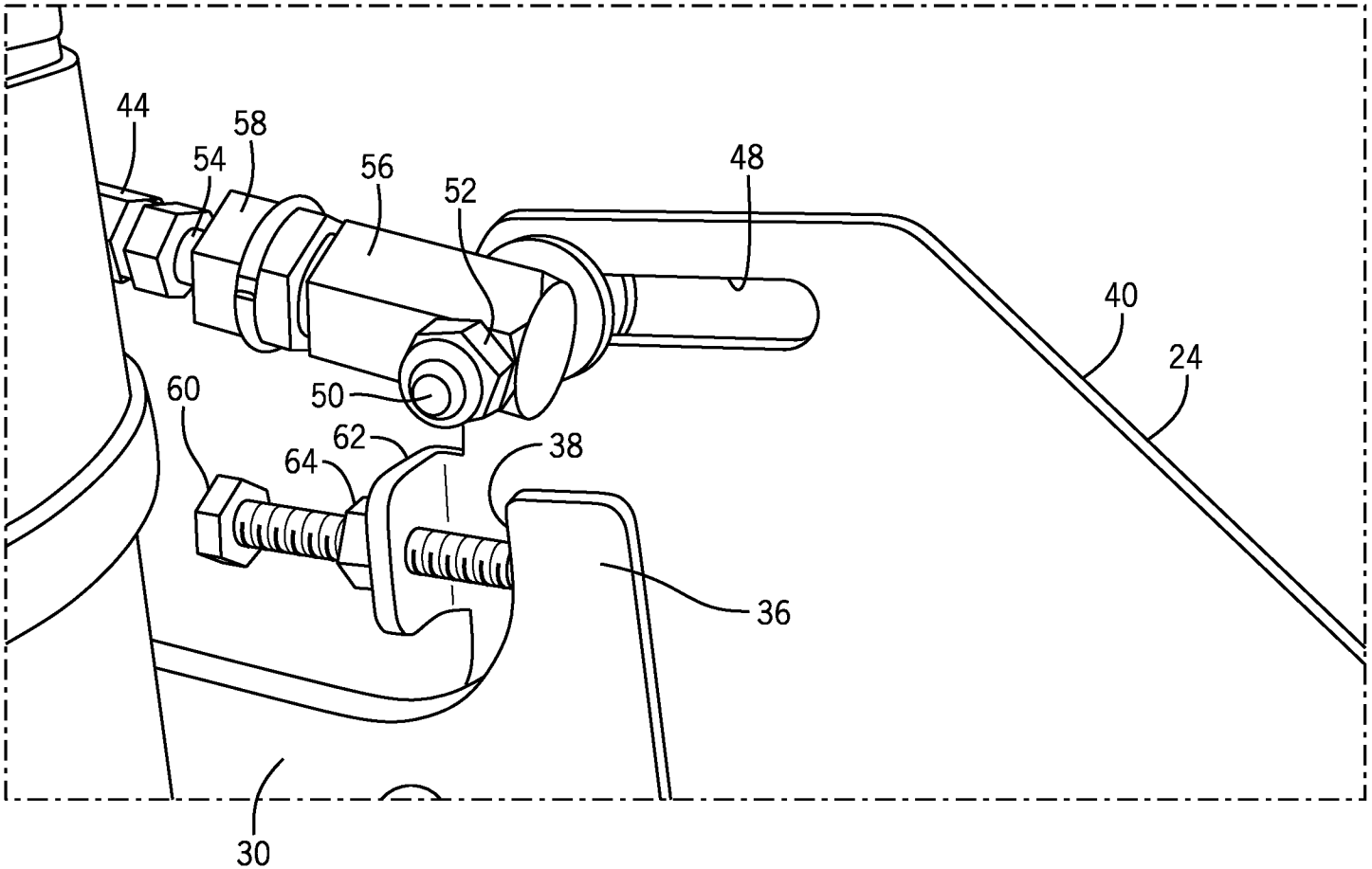
FIG. 5 is a detailed perspective view of the stop member and lifting arm of the deck assembly of FIG. 2, shown when the deck assembly is in the slightly raised position of FIG. 4.
Figure 6:
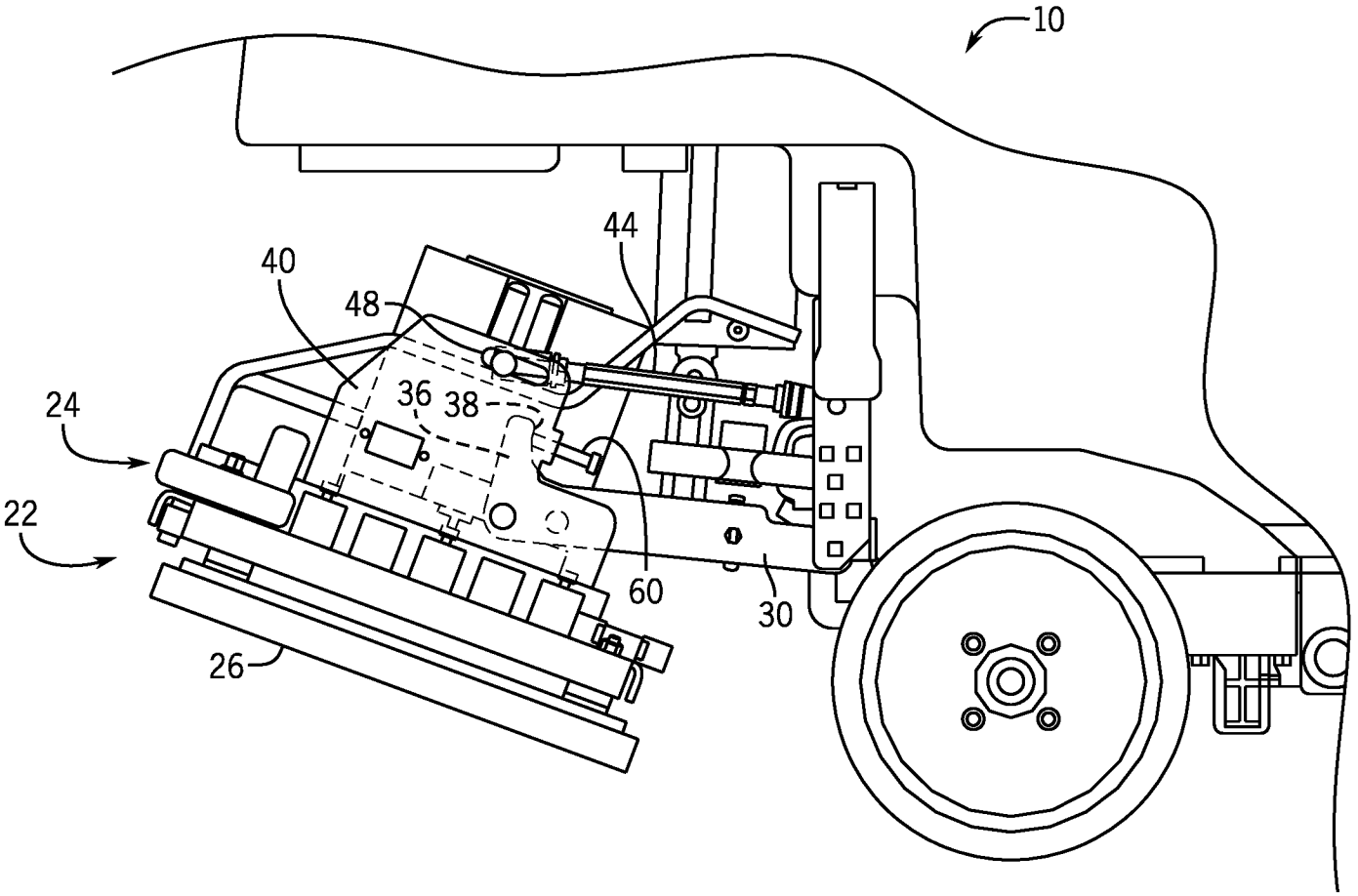
FIG. 6 is a detailed side view of a deck assembly on the floor maintenance machine of FIG. 1 in a tiled position.

With further reference to FIGS. 2-7, the adjustable deck assembly 22 is shown in detail. The adjustable deck assembly 22 can adjust a position of the scrub deck 24 relative to the frame 16 and can be used to level the scrub deck 24 over the floor surface. For example, the adjustable deck assembly 22 can tilt the scrub deck 24 upward (as shown in FIG. 6) when the floor maintenance machine is being loaded onto a ramp for transport. When the floor maintenance machine 10 is being used to clean a floor surface, the adjustable deck assembly 22 can maintain the scrub deck 24 approximately level to the floor surface (as shown in FIG. 2) to promote even floor surface cleaning and even wearing of the floor cleaning implement(s) 26 supported by the scrub deck.

Figure 3:
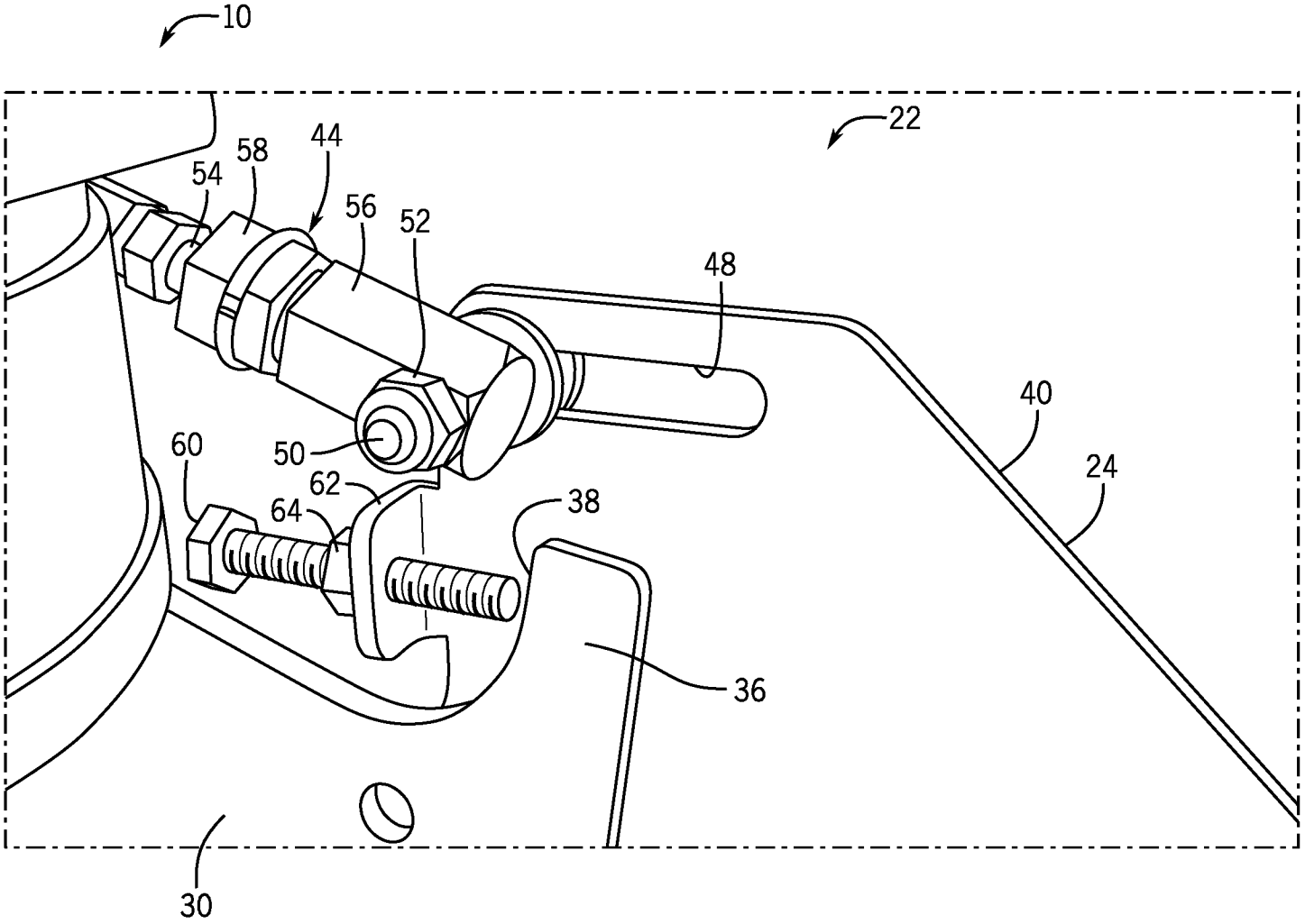
FIG. 3 is a detailed perspective view of a stop member and lifting arm of the deck assembly of FIG. 2.

With specific reference now to FIGS. 2 and 3, the adjustable deck assembly 22 is shown in a lowered, or "working" position. The adjustable deck assembly 22 includes one or more lifting arms 30 (e.g., a first and a second lifting arm having identical components and functions as described below with regard to lifting arms 30) rotatably coupled to and extending away from the frame 16. The lifting arms 30 can be formed of a rigid material, such as plate steel, and can be rotatably actuatable by a lifting mechanism 32 coupled to the frame 16. In some examples, the lifting mechanism 32 is hydraulic and can be actuated using the control panel 28. In other embodiments, the lifting mechanism 32 can include a gear drive (not shown) that rotates to alter the rotational orientation of the lifting arms 30. The lifting arms 30 can rotate about pivots 34 that are coupled to the frame 16.

In some embodiments, the lifting arms 30 have a major axis X-X extending along a length of the lifting arm 30. An arcuate section 36 extends away from the major axis X-X at a distal end of the lifting arm 30, and can be used to adjust an angle of the scrub deck 24 relative to the frame 16, as explained in further detail below. The arcuate section 36 can gradually curve away from the major axis X-X of the lifting arm 30 to define a stop engaging surface 38. In some embodiments, the arcuate section has its own axis Y-Y that forms an angle with the major axis X-X between about 30 degrees and about 150 degrees.

The lifting arms 30 can be rotatably coupled to one or more lifting flanges 40 formed on the scrub deck 24. The lifting flanges 40 can extend upwardly away from the floor cleaning implement(s) 26 and can provide a leverage point for the lifting arms 30 as they position (e.g., a height or angle) the scrub deck 24. The lifting arms 30 can be rotatably coupled to a pivot 42 (e.g., a pin or bolt) that extends through the lifting flange 40. The rotatable coupling between the lifting arms 30 and the lifting flanges 40 of the scrub deck 24 allows the lifting arms 30 to raise and lower the scrub deck 24 based upon the commands of a user.

One or more support members 44 can also be coupled to the scrub deck 24 and the frame 16. In some embodiments, the support members 44 are rotatably coupled to the frame 16 by a pivot 46. The support members 44 extend away from the frame 16 and can be movably coupled to the lifting flanges 40 of the scrub deck 24. For example, an elongate slot 48 can be formed in the lifting flange 40 above the pivot 42, and can receive a bolt 50 that allows both rotational and translational motion of the support member 44 relative to the lifting flange 40. The bolt 50 extends through the slot 48 and through the support member 44, and can receive nuts 52 to couple and secure the lifting flange 40 to the support member 44, as illustrated in FIG. 3.

The support members 44 can extend approximately parallel (i.e., within about 10 degrees) to the major axis X-X of the lifting arms 30, and can be used to help control the rotation of the scrub deck 24 as the lifting arms 30 rotate during a lifting or lowering process, as well as during normal cleaning operation. Due to the placement of the pivot 42 on the lifting flange 40 relative to the scrub deck 24 center of gravity, the position of the bolt 50 within the slot 48 (corresponding to the length of the support member 44) controls the tilt angle of the scrub deck 24. The slot 48 can be oriented so that when the bolt 50 and pivot 42 are vertically aligned, the scrub deck 24 is level to the floor surface below.

The tilt angle of the scrub deck can be controlled by adjusting a length of the support members 44 in the fully lowered position. In some embodiments, the support members 44 include a threaded rod portion 54 on each side that receives adjustable head assemblies 56. The threaded rod portions 54 can be threaded differently on each side (e.g., right-handed and left-handed threads) of the support member 44. A length adjustment nut 58 coupled to the adjustable head assembly 56 can be rotated about the threaded rod portion 54 to lengthen or shorten the support member 44, based upon the desired orientation of the scrub deck 24 relative to the floor surface below. For example, it may be advantageous to adjust a length of the support members 44 before initial use of the floor maintenance machine 10 to ensure that the scrub deck 24 is at least about parallel to the floor surface below. This can help ensure even floor cleaning implement wear during use.

A stop member 60 supported by the scrub deck 24 extends toward the arcuate section 36 or doglegged portion of the lifting arm 30. As shown in FIG. 3, the stop member 60 can be a hex bolt extending through a hole in a tab 62 formed in the lifting flange 40 of the scrub deck 24. The stop member 60 can be axially adjustable toward or away from the lifting arm 30 using a nut 64 that can be mounted to the tab 62, for example. In some embodiments, the hole in the tab 62 can be threaded to positionally lock the stop member 60 in place. As will be explained, the stop member 60 can be used to support the scrub deck 24 in an upwardly tilted position relative to the frame 16.

The stop member 60 is used to limit a degree of tilt of the scrub deck, as demonstrated by FIGS. 2-7. When the scrub deck 24 is positioned in the lowered "working" position of FIG. 2, the rotational orientation of the scrub deck 24 relative to the frame 16 is controlled by the positions of the pivot 42 and the bolt 50. As can be seen in FIGS. 2 and 3, the stop member 60 is not engaging the arcuate section 36 of the lifting arm 30 when the scrub deck is in the lowered "working" position. Further lowering of the lifting arms 30 will maintain the scrub deck 24 level to, and possibly contacting, the floor.

When the floor maintenance machine receives a command to raise the adjustable deck assembly 22 (e.g., from the control panel 28), the lifting mechanism 32 rotatably actuates the lifting arms 30, as shown in FIGS. 4 and 5. As the lifting arms 30 rotate upward (e.g., in a clockwise direction relative to the view in FIG. 6), the pivot 42 extending through the lifting flange 40 rotates upward to lift the scrub deck 24. The positioning of the pivot 42 rearward of the scrub deck 24 center of gravity causes the scrub deck 24 to tilt forward relative to the lifting arms 30 as the lifting arms 30 are raised.

The forward tilting of the scrub deck 24 causes the stop member 60 to engage the arcuate section 36 to limit relative rotation between the lifting arm 30 and the scrub deck 24 beyond a set angle. As the scrub deck 24 rotates forward, the stop member 60 (which is supported by the scrub deck) rotates into engagement with the stop engaging surface 38 of the lifting arm 30. The stop member 60 then drives into the lifting arm 30 and prevents further forward rotation of the scrub deck 24 relative to the lifting arm 30 as they continue to rise. This constrains the scrub deck 24 relative to the lifting arm 30, and allows the scrub deck 24 to be lifted and tilted backward to provide a larger approach angle for a ramp (not shown) that might be used to transport the floor maintenance machine 10.

Figure 7:
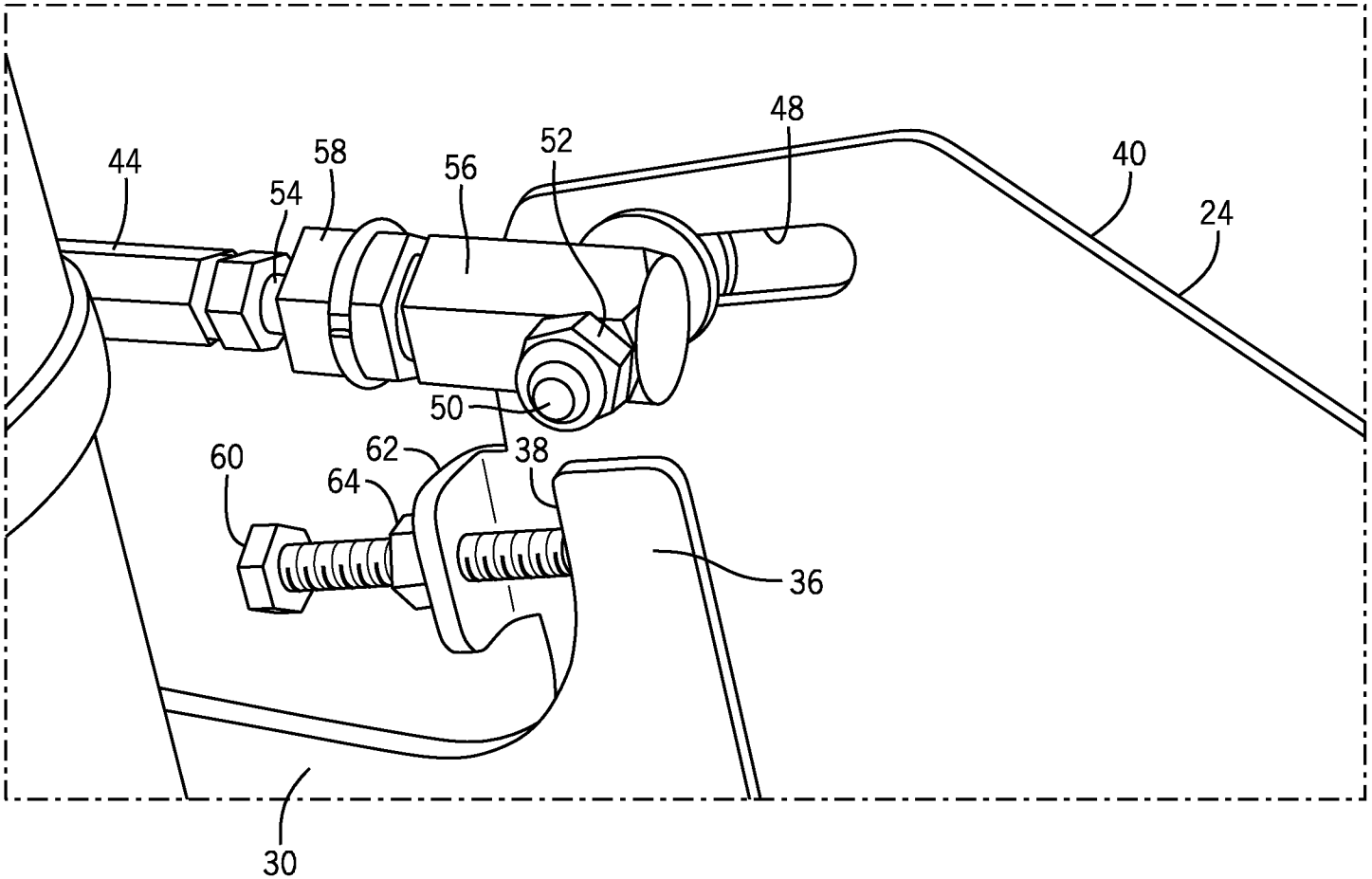
FIG. 7 is a detailed perspective view of the stop member and lifting arm of the deck assembly of FIG. 2, shown when the deck assembly is in the slightly raised position of FIG. 6.

Once the stop member 60 has engaged the lifting arm 30, the scrub deck 24 can be lifted while maintaining a constant angle relative to the lifting arms 30. As shown in FIGS. 6 and 7, the scrub deck 24 can be lifted and tilted backward simultaneously by the upward rotation of the lifting arms 30. As the scrub deck 24 continues to tilt and raise, the bolt 50 travels within the slot 48 so as to allow the scrub deck 24 to maintain a constant angle with the lifting arms 30. The stop member 60 continues to restrict the scrub deck 24 from forward rotation relative to the lifting arms 30.

The axial position of the stop member 60 relative to the arcuate section 36 of the lifting arm 30 can determine the maximum allowable rotation (i.e., the set angle) between the lifting arm 30 and the scrub deck 24 before the lifting arm 30 engages the stop member 60. The stop member 60 can be axially adjustable relative to the lifting arm 30 to change the tilt angle of the scrub deck 24, which may be advantageous depending upon a ramp gradient that the floor maintenance machine 10 is to be driven over. In some examples, the stop member 60 may limit the allowable rotation between the lifting arm 30 and the scrub deck 24 to between about 0 and about 30 degrees. In some examples, the stop member 60 limits the allowable rotation between the lifting arm 30 and the scrub deck 24 to between about 0 and about 10 degrees, or less.

Rotation of the scrub deck 24 relative to the lifting arms 30 can still occur to a limited extent when the scrub deck is in a lowered position. For example, considering the lowered configuration in FIG. 4, given the placement of the stop member 60 and the arcuate sections 36 of the lifting arms 30, nothing precludes the scrub deck 24 from rotating in a clockwise direction so the front or nose of the scrub deck 24 can be forced upwards relative to the rear side. This can allow the scrub deck 24 to tilt upward and follow a ramp, should the floor maintenance machine board a ramp without first raising and tilting the scrub deck 24 as discussed above. This can provide additional safeguarding against component bending or failure.

It should be appreciated that various other modifications and variations to the preferred embodiments can be made within the spirit and scope of the disclosure. Therefore, the disclosure should not be limited to the described embodiments. To ascertain the full scope of the disclosure, the following claims should be referenced.

I claim:

1. A floor maintenance machine having an adjustable deck assembly, the floor maintenance machine comprising:

a deck supporting a floor cleaning implement;

a lifting arm extending away from a frame of the floor maintenance machine and rotatably coupled to the deck, the lifting arm being rotatably actuatable to adjust a position of the deck relative to the frame;

a support member rotatably coupled to the frame and movably coupled to the deck; and a stop member supported by the deck and extending toward the lifting arm for selective engagement therewith;

wherein, when the lifting arm is rotated relative to the frame to lift the deck, the stop member is driven into the lifting arm to limit relative rotation between the lifting arm and the deck beyond a set angle; and wherein a distal end of the lifting arm has an arcuate section extending away from a major axis of the lifting arm.

2. The floor maintenance machine of claim 1, wherein the arcuate section has an axis extending away from the major axis of the lifting arm at an angle of between about 30 degrees and about 150 degrees.

3. The floor maintenance machine of claim 1, wherein the stop member extends through the deck toward the arcuate section.

4. The floor maintenance machine of claim 1, wherein the stop member is axially adjustable toward or away from the arcuate section of the lifting arm.

5. The floor maintenance machine of claim 4, wherein the stop member is a bolt threadably coupled to the deck.

6. The floor maintenance machine of claim 1, wherein the deck comprises a lifting flange that extends upwardly away from the cleaning implement.

7. The floor maintenance machine of claim 6, wherein a pivot extends through the lifting flange and the lifting arm to rotatably couple the deck to the lifting arm.

8. The floor maintenance machine of claim 7, wherein a bolt extends through the lifting flange and the support member to movably couple the deck to the support member.

9. The floor maintenance machine of claim 1, wherein the lifting arm is rotatably actuatable by a hydraulic lifting mechanism coupled to the frame.

10. The floor maintenance machine of claim 1, wherein the lifting arm and the support member extend toward the deck approximately parallel to one another.

11. The floor maintenance machine of claim 1, wherein the set angle is between about 0 degrees and about 30 degrees.

12. The floor maintenance machine of claim 11, wherein the set angle is between about 0 degrees and about 10 degrees.

13. The floor maintenance machine of claim 1, further comprising a second lifting arm extending away from the frame of the floor maintenance machine and rotatably coupled to the deck, a second support member rotatably coupled to the frame and movably coupled to the deck; and a second stop member supported by the deck and extending toward the lifting arm for selective engagement therewith.

14. A floor maintenance machine having an adjustable deck assembly, the floor maintenance machine comprising:

a deck supporting a floor cleaning implement and comprising a lifting flange that extends upwardly away from the cleaning implement;

a lifting arm extending away from a frame of the floor maintenance machine and rotatably coupled to the deck, the lifting arm being rotatably actuatable to adjust a position of the deck relative to the frame;

a pivot extending through the lifting flange and the lifting arm to rotatably couple the deck to the lifting arm;

a support member rotatably coupled to the frame and movably coupled to the deck;

a stop member supported by the deck and extending toward the lifting arm for selective engagement therewith;

a bolt extending through the lifting flange and the support member to movably couple the deck to the support member, the bolt being received within an elongate slot formed through the lifting flange; and wherein, when the lifting arm is rotated relative to the frame to lift the deck, the stop member is driven into the lifting arm to limit relative rotation between the lifting arm and the deck beyond a set angle.

15. The floor maintenance machine of claim 14, wherein the elongate slot is positioned in the lifting flange above the pivot.

16. A floor maintenance machine having an adjustable deck assembly, the floor maintenance machine comprising:

a deck supporting a floor cleaning implement;

a lifting arm extending away from a frame of the floor maintenance machine and rotatably coupled to the deck, the lifting arm being rotatably actuatable to adjust a position of the deck relative to the frame;

a support member rotatably coupled to the frame and movably coupled to the deck; and a stop member supported by the deck and extending toward the lifting arm for selective engagement therewith;

wherein, when the lifting arm is rotated relative to the frame to lift the deck, the stop member is driven into the lifting arm to limit relative rotation between the lifting arm and the deck beyond a set angle and wherein the support member has an adjustable length.

17. A floor maintenance machine having an adjustable deck assembly, the floor maintenance machine comprising:

a deck supporting a floor cleaning implement;

a lifting arm extending away from a frame of the floor maintenance machine and rotatably coupled to the deck, the lifting arm being rotatably actuatable to adjust a position of the deck relative to the frame;

a support member rotatably coupled to the frame and movably coupled to the deck; and a stop member supported by the deck and extending toward the lifting arm for selective engagement therewith;

wherein, when the lifting arm is rotated relative to the frame to lift the deck, the stop member is driven into the lifting arm to limit relative rotation between the lifting arm and the deck beyond a set angle and wherein the stop member extends through a tab formed on a rear of the deck.

18. A floor maintenance machine having an adjustable deck assembly, the floor maintenance machine comprising:

a deck supporting a floor cleaning implement;

a lifting arm extending away from a frame of the floor maintenance machine and rotatably coupled to the deck, the lifting arm being rotatably actuatable to adjust a position of the deck relative to the frame, a distal end of the lifting arm having an arcuate section extending away from a major axis of the lifting arm;

a stop member supported by the deck and extending toward the lifting arm for selective engagement therewith;

wherein the lifting arm is configured to rotate relative to the frame thereby lifting the deck; and wherein, upon lifting the deck, the deck rotates until the stop member contacts the lifting arm thereby preventing further rotation of the deck.

19. The floor maintenance machine of claim 18, wherein a position of the stop member limits an angle defined between the deck and a surface of the floor.

* * * * *